US009624927B2

(12) United States Patent
Bahnen et al.

(10) Patent No.: US 9,624,927 B2
(45) Date of Patent: Apr. 18, 2017

(54) VACUUM PUMP

(75) Inventors: Rudolf Bahnen, Roetgen (DE); Uwe Drewes, Velbert (DE); Klaus Rofall, Breckerfeld (DE); Markus Loebel, Bochum (DE)

(73) Assignee: Gebr. Becker GmbH, Wuppertal (DE)

( * ) Notice: Subject to any disclaimer, the term of this patent is extended or adjusted under 35 U.S.C. 154(b) by 20 days.

(21) Appl. No.: 13/885,054

(22) PCT Filed: Dec. 6, 2011

(86) PCT No.: PCT/EP2011/071882
§ 371 (c)(1),
(2), (4) Date: May 13, 2013

(87) PCT Pub. No.: WO2012/080034
PCT Pub. Date: Jun. 21, 2012

(65) Prior Publication Data

US 2013/0224055 A1 Aug. 29, 2013

(30) Foreign Application Priority Data

Dec. 14, 2010 (DE) ..... 10 2010 061 202

(51) Int. Cl.
*F04C 18/00* (2006.01)
*F04C 18/16* (2006.01)
(Continued)

(52) U.S. Cl.
CPC ..... *F04C 18/00* (2013.01); *F04C 18/084* (2013.01); *F04C 18/16* (2013.01); *F04C 28/26* (2013.01); *F04C 29/04* (2013.01); *F04C 2240/20* (2013.01)

(58) Field of Classification Search
CPC ..... F04C 18/084; F04C 28/26; F04C 29/04; F04C 18/00; F04C 18/16; F04C 2240/20
(Continued)

(56) References Cited

U.S. PATENT DOCUMENTS 2,410,172 A * 10/1946 Lysholm ..... F04C 18/16 418/182
6,544,020 B1 * 4/2003 Bahnen et al. ..... 418/88
(Continued)

FOREIGN PATENT DOCUMENTS

DE 10 2005 012040 9/2006
DE WO 2006097478 A1 * 9/2006 ..... F04C 18/084
(Continued)

OTHER PUBLICATIONS

International Search Report of PCT/EP2011/071882, date of mailing Jun 18, 2012.

*Primary Examiner* — Nicholas J Weiss
*Assistant Examiner* — Wesley Harris
(74) *Attorney, Agent, or Firm* — Collard & Roe, P.C.

(57) ABSTRACT

The invention relates to a vacuum pump, in particular a screw pump, having preferably two displacement body shafts (2, 3), coupled via a gearing, which drive displacement bodies (12, 13), and having an inner recess (14), extending in the direction of a geometric axis (A) of the displacement body shaft (2, 3), in which a tubular body (20) extends for conducting cooling fluid while leaving a free space between an inner surface of the recess (14) and an outer surface of the body (20). To provide a vacuum pump which has a configuration having a simple construction and which is effective with regard to cooling power, it is proposed that the body (20) is in addition secured in a separate cover part (15) mounted on the suction-side end of the displacement body (12, 13), and that the free space is formed, at least in part, directly between the body (20) and the inner surface of the displacement body (12, 13) and extends continuously from the cover part (15) to a securing region of the body (20) in the displacement body shaft (2, 3), in a region of the displacement body shaft (2, 3) associated
(Continued)

Figure 1:
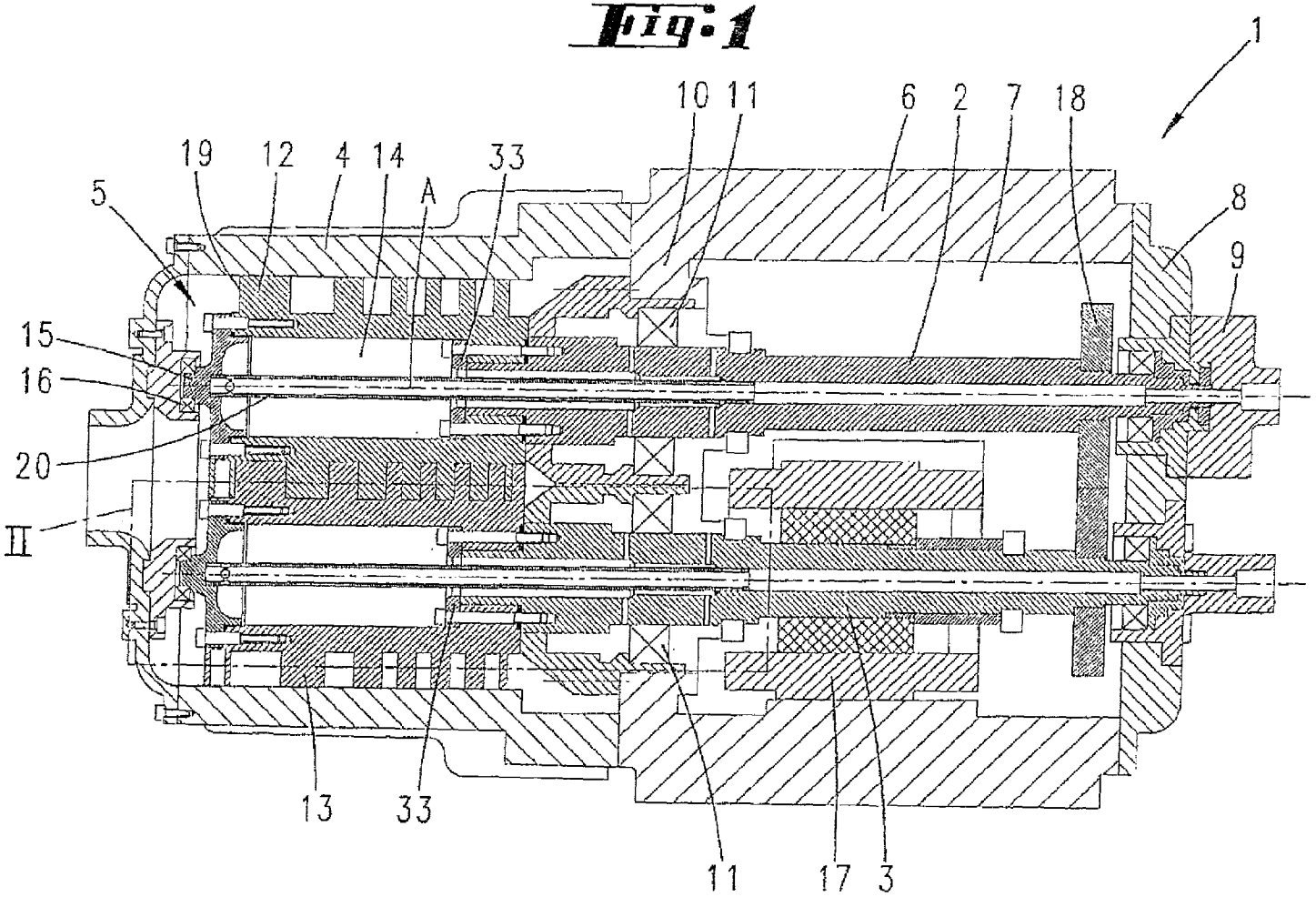

with the motor/gearing housing (4) of the displacement body shaft (2, 3).

8 Claims, 2 Drawing Sheets

(51) Int. Cl.
*F04C 28/26* (2006.01)
*F04C 29/04* (2006.01)
*F04C 18/08* (2006.01)

(58) Field of Classification Search
USPC ..... 418/88, 91, 94, 201.1, 206.1, 206.3; 417/228
See application file for complete search history.

(56) References Cited

U.S. PATENT DOCUMENTS

| | | | | |
|---|---|---|---|---|
| 7,458,790 | B2 * | 12/2008 | Yamamoto | F04C 18/16 184/6.16 |
| 2004/0091380 | A1 | 5/2004 | Kriehn et al. | |
| 2005/0069446 | A1 | 3/2005 | Kriehn | |

FOREIGN PATENT DOCUMENTS

| | | |
|---|---|---|
| DE | 10 2010 064388 | 8/2011 |
| EP | 1 242 742 | 9/2002 |
| WO | WO 02/12726 | 2/2002 |
| WO | WO 2012/055734 A2 | 5/2012 |

* cited by examiner

VACUUM PUMP

CROSS REFERENCE TO RELATED APPLICATIONS

This application is the National Stage of PCT/EP2011/071882 filed on Dec. 6, 2011, which claims priority under 35 U.S.C. §119 of German Application No. 10 2010 061 202.2 filed on Dec. 14, 2010, the disclosure of which is incorporated by reference. The international application under PCT article 21(2) was not published in English.

The invention relates to a vacuum pump, in particular a screw pump, having preferably two displacement body shafts, coupled via a gearing, which drive displacement bodies, a displacement body having a suction-side end and a pressure-side end and being cooled on the inside, and the vacuum pump having a housing which is divided into a motor/gearing chamber and a working chamber, and in addition a displacement body having an inner recess, extending in the direction of a geometric axis of the displacement body shaft, in which a tubular body extends for conducting cooling fluid while leaving a free space between an inner surface of the recess and an outer surface of the body, the cooling fluid being able to enter the free space from the body, and the body being secured in the displacement body shaft.

These types of vacuum pumps are already known. A distinction may be made between vacuum pumps having direct displacement body cooling and vacuum pumps which in this respect are not directly cooled. With regard to the prior art for vacuum pumps having direct displacement body cooling, reference is to be made in particular to EP 1 242 742 B1 and US 2005/0069446 A1. Reference is also to be made to DE 10 2010 060 199. Vacuum pumps having direct cooling of the displacement bodies have the advantage that no significant temperature differences result between the pump housing and the displacement bodies or the displacement body shafts during operation. In addition, removal of heat from the displacement bodies may be ensured, regardless of the gas flow delivered, even during operation under high pressure on the pressure side. In an embodiment of a vacuum pump known from the first-cited publication, reference being made, for example, to FIG. 3 of that publication, the tubular body is provided extending inside the displacement body shaft. A wall of the displacement body shaft having a tubular shape in this region extends between an outer surface of the body and an inner surface of the displacement body. The cooling fluid exiting from the tubular body initially flows into the cavity in the displacement body shaft, and from there into the recess in the displacement body through which the displacement body shaft passes.

On this basis, it is a technical object of the invention to provide a vacuum pump which has a configuration having a simple construction and which is effective with regard to cooling power.

One possible approach to achieving the object is provided according to a first inventive concept by subject matter in which the body is in addition secured in a separate cover part mounted on the suction-side end of the displacement body, and the free space is formed, at least in part, directly between the body and the inner surface of the displacement body. As a result of the tubular body being secured on the one hand to the displacement body shaft but on the other hand to the displacement body itself by means of the separate cover part mounted thereon, the displacement body shaft itself may advantageously have a short design. The displacement body shaft does not have to pass through this recess, at least not to a significant degree. In addition, the body is directly accessible after the cover is removed. Due to the free space being formed, at least in part, directly between the body and the inner surface of the displacement body, cooling fluid exiting from the body may easily reach the displacement body and remove heat. Favorable flow conditions, in particular also low flow pressure losses, for the cooling fluid, are ensured.

Further features of the invention are described and illustrated below, also in the description of the figures and in the drawings, often in their preferred association with the concept explained above, but may also be of importance in an association with only one or more individual features which are described herein or illustrated in the drawings, or independently or in some other overall concept.

The free space preferably extends continuously, and particularly preferably free of built-in components, from the cover part to a securing region of the body in the displacement body shaft. In addition, the securing region is preferably provided in a region of the displacement body shaft associated with the motor/gearing housing of the displacement body shaft. The free space, which is formed to be free of built-in components practically over the entire length of the passage region, results in a simple and effective configuration of the space into which the cooling fluid exiting from the body may flow. This also results in a configuration that is favorable with regard to installation.

It is further preferred that the recess is cylindrical.

It is also preferred that the cooling fluid exits in the region of an end face of the cover part facing the interior of the free space. It is further preferred that the cooling fluid exits from the tubular body only at this location. Thus, the cooling fluid exits at the suction-side end of the displacement body, and from there may flow back, preferably into the motor/gearing chamber. The lowest temperatures prevail at the suction-side end of the displacement body. Thus, the cooling fluid exits at the cool end of the displacement body, and in the counterflow principle with regard to the temperature profile may then remove heat from the displacement body.

The tubular body is accommodated in a corresponding receiving recess in the displacement body shaft. In this regard, the receiving recess preferably has a securing portion, and a passage portion having a larger cross-section. The passage portion is more preferably formed on the displacement body side of the securing portion.

It is further preferred that the cooling fluid is injectable into the securing portion for entrance into the body, which is open in an axial direction of the securing portion. The body may in particular be formed as a conventional tubular body having a uniform wall thickness over its entire length. Together with the recess, which as stated is preferably cylindrical, in the displacement body, through which the tubular body passes freely, at least over a substantial portion of its length associated with the displacement body, this results in a comparatively large circular ring-shaped cavity in this region of free passage, which may utilized for the cooling fluid.

For returning the cooling fluid, which is preferably oil, radial bores are preferably formed in the passage portion of the displacement body shaft, in a region of the displacement body shaft that is associated with the motor/gearing chamber. The oil or the cooling fluid at a high temperature may thus flow back into the motor/gearing chamber. The circuit of the cooling fluid is determined practically solely by the injection of the cooling fluid into the tubular body.

The displacement body shaft may also be supported on the suction side by means of the displacement body, particularly preferably by means of the cover part. With regard to its structural configuration, the tubular body may be designed solely to conduct the cooling fluid, In particular, the tubular body may also be made of a different material, for example a light metal such as aluminum, than the displacement body or the displacement body shaft, for which a steel material is preferred. For a two-part design of displacement bodies and displacement body shafts, the displacement bodies may also be made of a different material than the displacement body shafts, for example also aluminum.

Figure 2:
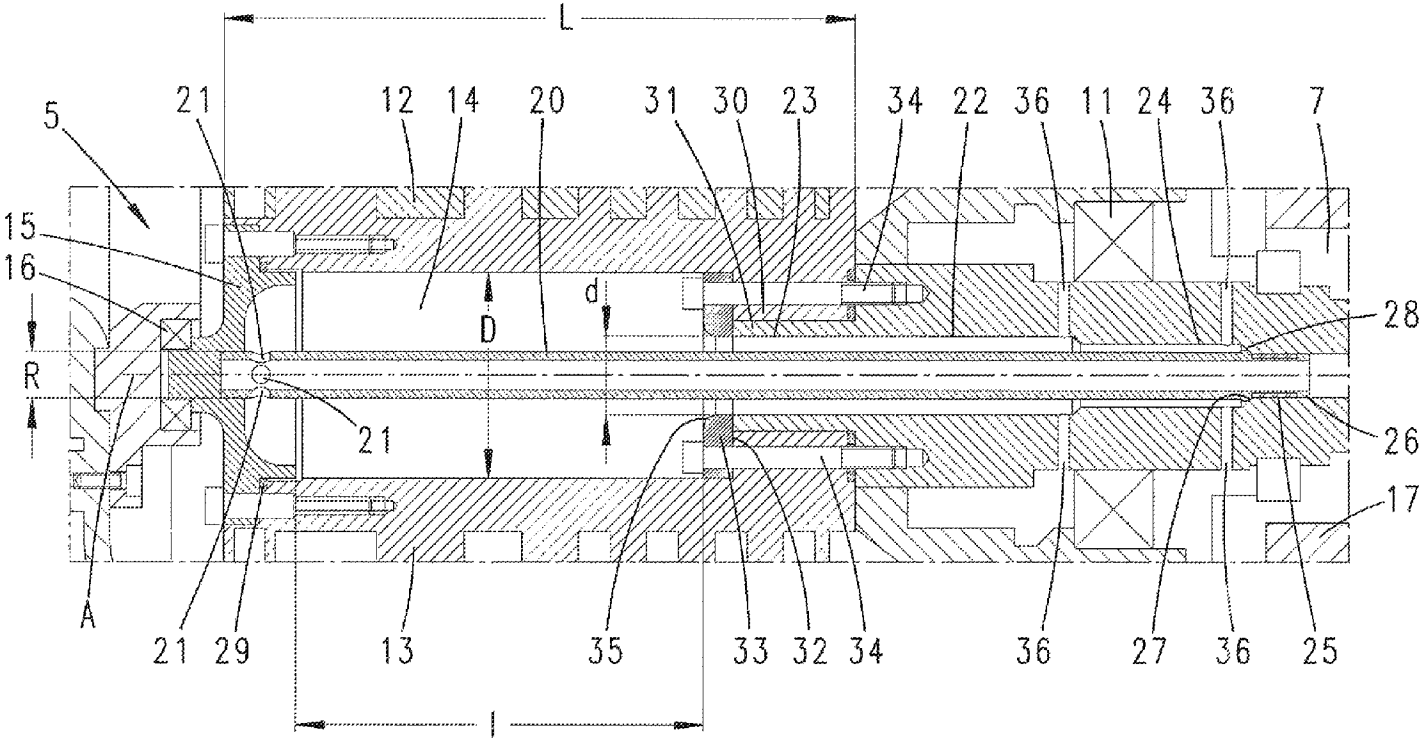

The invention is explained in greater detail below with reference to the appended drawings, which illustrate an exemplary embodiment strictly by way of example. The drawings show the following:

FIG. 1 shows a schematic cross-sectional view of a vacuum pump having internally cooled displacement bodies; and FIG. 2 shows an enlargement of the region of the illustration in FIG. 1 delimited by a dashed line.

A vacuum pump 1 shown in cross-section in FIG. 1 is illustrated and described, which in the exemplary embodiment is formed as a screw pump. The vacuum pump 1 has a first displacement body shaft 2 and a second displacement body shaft 3. A displacement body shaft 2, 3 has a geometric (longitudinal) axis A.

The pump is preferably a dry-running pump.

The vacuum pump 1 also has a pump housing which is divided into a housing part 4 relating to a working chamber 5, and a housing part 6 which forms a motor/gearing chamber 7. The housing parts 4, 6, in particular the housing part 6, are housing parts that are radially closed with respect to the displacement body shafts 2, 3, and preferably in this regard, integrally formed. The housing parts may be (steel or aluminum) cast parts, for example.

The housing part 6 is closed off at the rear by a closing plate 8 in which the displacement body shafts 2, 3 are mounted at the end. In the present case, an oil pump 9 (only schematically indicated) for the displacement body shaft 2 is also situated on the outside of the closing part 8, and is also driven by the displacement body shaft 2. The oil pump 9 also provides the oil supply in the motor/gearing chamber 7, and, due to the implementation as liquid oil, also provides the cooling fluid and its transport and circulation, as described in greater detail below.

A partition wall 10 is formed between the motor/gearing chamber 7 and the working chamber 5. The displacement body shafts 2, 3 are supported in the partition wall 10 by means of bearings 11.

The displacement body shafts 2, 3 together with displacement bodies 12, 13, respectively, are provided on the working chamber side. In the exemplary embodiment, the displacement body shafts and displacement bodies cooperate in a customary way, in a screw-like manner but without touching. In principle, the displacement bodies 12, 13 may be formed in one piece with the respective displacement body shaft 2, 3. In the exemplary embodiment and in the preferred case, however, they are formed separately, and joined to the displacement body shafts by a positive-fit and/or screw connection, for example.

Associated with their suction-side end region, the displacement bodies 12, 13 which in each case are formed with a cylindrical recess 14 are mounted, via a bearing 16, in the housing 4 by means of a cover part 15 which covers the recess 14. The cover part 15 is secured directly to a displacement body 12, 13, and rotates together with same. The cover part 15 may be easily sealed with respect to the displacement body shaft or the respective displacement body by means of an O-ring 29.

In the exemplary embodiment, the displacement body shafts 2, 3 are also driven via a single motor 17 which cooperates with the displacement body shaft 3, and are coupled to one another via a gearing 18. The recess 14 formed in the displacement body 12 or 13 extends, beginning at a suction-side end 19 of a displacement body 12 or 13, over a substantial portion of the length of the displacement body 12 or 13, concentrically with respect to a longitudinal axis A of a displacement body shaft 2, 3 or of the displacement body 12, 13, respectively.

A tubular body 20 extends within the recess 14, likewise concentrically with respect to the axis A. The tubular body 20 is secured on the one hand in the cover part 15 and on the other hand in the displacement body shaft 2. The tubular body accordingly rotates together with the displacement body shaft 2 or 3, or the displacement body 12 [or 13], respectively.

The tubular body 20 (also see FIG. 2 in particular) is used for conducting cooling fluid, which in the exemplary embodiment is liquid oil that is pumped into the motor/gearing chamber 7 and circulated therein by means of the oil pump 9, all the way to the suction-side end of a displacement body 12, 13. For this purpose, the tubular body 20 has outlet openings 21 for the cooling fluid in the region of the cover part 15. The exit of the cooling fluid directly at the cover part 15 is also advantageous with respect to cooling of the bearing 16. In particular (not illustrated separately), however, the cooling fluid is injected into the displacement body shaft 2, 3, specifically into a region associated with the motor/gearing chamber 7, before the tubular body 20 begins as viewed in the direction of a displacement body 12, 13.

The recess 14 initially has a larger diameter D, viewed from the suction-side end of a displacement body 12 or 13, and then has a smaller diameter d. The larger diameter D preferably corresponds to 3 to 7 times an outer diameter R of the tubular body 20. The smaller diameter d preferably corresponds to 1.2 to 2 times the outer diameter R of the tubular body 20.

The region of the larger diameter D of the recess 14 also extends in the displacement body 12 or 13 over a length l, viewed from the cover part 15, which preferably corresponds to ½ to ⅘ of the total length L of a displacement body 12 or 13.

As is apparent, the tubular body 20 in addition passes freely through a bore 22 in the displacement body shaft 2 or 3. This bore 22 preferably has the same diameter as, and is in alignment with, the bore 23 in the displacement body 12 or 13 having the diameter d. The bore 22 in the displacement body shaft 2 or 3 then merges into a bore 24 in the displacement body shaft 2 or 3 that has a smaller diameter, in which the tubular body 20 is situated so that it continues to pass through freely. The bores 22, 24 together represent a passage portion of the displacement body shaft 2, 3. Lastly, for forming a securing portion, adjoining the bore 24, a mounting bore 25 having an even smaller diameter is formed in the displacement body shaft 2 or 3, in which an end 26 of the tubular body 20 is mounted. The end 26 is a region that is reduced on the outside with respect to the wall thickness of the tubular body 20, so that an abutment shoulder 27 on the tubular body 20 results, which abuts against a corresponding bearing shoulder 28 of the displacement body shaft 2, 3. As a result of the abutment shoulder 27 abutting against the bearing shoulder 28 on the one hand, and [on the other hand] the tubular body 20 engaging in the cover part 15 at the other end, the axial position of the tubular body 20 in the combination of the displacement body shaft and the displacement body is fixed. The end 26 may be held in the displacement body shaft 2, 3 by means of a spring element, for example, corresponding to a slot and key connection known for shafts, by radially fixed spring-loading.

In particular, adjoining the recess 14, viewed from the cover 15, the displacement body 12, 13 has a fitting bore portion 30 in which a connecting portion 31 of the displacement body shaft 2, 3 is situated. A disk element 33, through which securing screws 34 pass, is mounted on an end face 32 of the connecting portion 31.

Associated with the bore 23, for the transition into same, the disk element 33 has a corresponding bore with a chamfer 35 formed on the inflow side.

A plurality of radial bores 36 originate from the bore 22 in the displacement body shaft 2, 3 or the bore 24 in order to conduct the cooling fluid, flowing back through these bores on the outside of the tubular body 20, into the motor/gearing chamber 7. In this case, the radial forces produced by the revolution of the displacement body shafts 2, 3 result in a practically automatic back-flow of the cooling fluid into the chamber. Viewed from the working chamber 5, some of the bores 36, as illustrated, may also open into a space surrounding the displacement body shaft 2, 3, in front of the bearings 11.

With regard to the disclosure, the ranges and value ranges stated above also include all values in between, in particular in 1/10 increments of the particular ratio, on the one hand for delimiting the mentioned range limits from below and/or above, but alternatively or additionally, also with regard to the disclosure of one or more single values from a particular range.

All features disclosed are (in themselves) pertinent to the invention. The disclosure content of the associated/accompanying priority documents (copy of the prior application) is also hereby included in full in the disclosure of the application, including for the purpose of incorporating features of these documents in claims of the present application. The subsidiary claims in their optional subordinated formulation characterize independent inventive refinement of the prior art, in particular to undertake divisional applications based on these claims.

LIST OF REFERENCE NUMERALS t,?

1 Vacuum pump 27 Abutment shoulder
2 Displacement body shaft 28 Bearing shoulder
3 Displacement body shaft 29 O-ring
4 Housing 30 Fitting bore portion
5 Working chamber 31 Connecting portion
6 Housing part 32 End face
7 Motor/gearing chamber 33 Disk element
8 Closing part 34 Securing screws
9 Oil pump 35 Chamfer
10 Partition wall 36 Radial bores
11 Bearing D Diameter
12 Displacement body d Diameter
13 Displacement body R Outer diameter
14 Recess l Length
15 Cover L Total length
16 Bearing A Geometric axis
17 Motor
18 Gearing
19 Suction-side end
20 Tubular body
21 Outlet opening
22 Bore
23 Bore
24 Bore
25 Mounting bore
26 End

The invention claimed is:

1. A vacuum screw pump comprising,
two displacement body shafts (2,3);
a gearing (12, 13), which couples the two displacement body shafts;
each displacement body shaft (2, 3) having a working chamber end and a displacement body end and being cooled on the inside;
a housing (4, 6) which is divided into a motor/gearing chamber (7) including a motor as well as a gearing, and a working chamber (5);
a displacement body (12, 13) having an inner recess (14), extending in the direction of a geometric axis (A) of the displacement body shaft (2, 3);
a tubular body (20) including an outer surface, the tubular body extends within the inner recess for conducting cooling fluid while defining a free space between an inner surface of the recess (14) and the outer surface of the tubular body;
the cooling fluid able to enter the free space from the tubular body (20), and the tubular body (20) being secured in the displacement body shaft (2, 3),
a separate cover part (15);
a bearing (16);
in addition the tubular body (20) being secured in the separate cover part (15) mounted on a suction-side end of the displacement body (12, 13), and by said separate cover part the displacement bodies are mounted the bearing (16) in the housing (4);
the free space being formed, at least over a length, starting from the cover part (15) of one half up to 4/5 of the overall length (L) of the displacement body (12, 13), and said free space is directly between the outer surface of the tubular body (20) and the inner surface of the recess (14) and the free space extending continuously from the cover part (15) to a securing region of the tubular body (20) in the displacement body shaft (2, 3), and
wherein the securing region of the tubular body (20) is except for the separate cover part (15) only provided in the motor/gearing chamber (7) of the housing (4, 6).

2. Vacuum screw pump according to claim 1, wherein the cooling fluid exits in the region of an end face of a displacement body (12, 13,).

3. Vacuum screw pump according to claim 1, wherein the tubular body (20) is accommodated in a corresponding receiving recess in the displacement body shaft (2, 3).

4. Vacuum screw pump according to claim 3, wherein the receiving recess has the securing portion and a passage portion form by bores provided with an opening cross-section.

5. Vacuum screw pump according to claim 1, Wherein the tubular body (20) has one or more bores (36) extending in the radial direction for the passage of cooling fluid.

6. Vacuum screw pump according to claim 1, wherein the cooling fluid is injectable into the displacement body shaft (2, 3) for entry into the tubular body (20), which is open in an axial direction of the securing portion.

7. A vacuum screw pump comprising,
two displacement body shafts (2,3);

a gearing (12, 13), which couples toe two displacement body shafts;

each displacement body shaft (2, 3) having a working chamber end and a displacement body and end being cooled on the inside;

a housing (4, 6) which is divided into a motor/gearing chamber (7) including a motor as well as a gearing, and a working chamber (5);

a displacement body (12, 13) having an inner recess (14), extending in the direction of a geometric axis (A) of the displacement body shaft (2, 3);

a tubular body (20) including an outer surface, the tubular body extends within the inner recess for conducting cooling fluid while defining a free space, between an inner surface of the recess (14) and the outer surface of the tubular body;

a separate cover part (15);

a bearing (16);

the cooling fluid being able to enter the free space from the tubular body (20), and the tubular body (20) being secured in the displacement body shaft (2, 3), in addition the tubular body (20) being secured in the separate cover part (15) mounted on a suction-side end of the displacement body (12, 13), and by said separate cover part the displacement bodies are mounted via the bearing (16) in the housing (4);

the free space being formed, at least over a length, starting from the cover part (15)of one half up to ⅘ of the overall length (L) of the displacement body (12,13) directly between the tubular body (20) and inner surface of the displacement body (12, 13) and the free space extending continuously from the cover (15) to a securing region of the tubular body part (20) in the displacement body shaft (2, 3), wherein the securing region of the tubular body (20) is except for the separate cover part (15) only provided in the motor/gearing chamber (7) of the housing (4, 6)

and wherein the free space is between the tubular body (20), which is formed, over its entire length, as a conventional tubular body having a uniform wall thickness, and the inner surface of the displacement body (12, 13).

8. A vacuum screw pump comprising, two displacement body shafts (2,3);

a gearing (12, 13), which couples the two displacement body shafts;

each displacement body shaft (2, 3) having a working chamber end and a displacement body end and being cooled on the inside;

a housing (4, 6) which is divided into a motor/gearing chamber (7) including motor as well as a gearing, and a working chamber (5);

a displacement body (12, 13) having an inner recess (14), extending in the direction of a geometric axis (A) of the displacement body shaft (2, 3);

a tubular body (20) including an outer surface, the tubular body extends within the inner recess for conducting cooling fluid while defining a free space between an inner surface of the recess (14) and the outer surface of the tubular body;

a separate cover part (15);

a bearing (16);

the cooling fluid being able to enter the free space from the tubular body (20), and the tubular body (20) being secured in the displacement body shaft (2, 3), tubular body (20) being secured in the separate cover part (15) mounted on a suction-side end of the displacement body (12, 13), and by said separate cover part the displacement bodies are mounted via the bearing (16) in the housing (4);

the free space being formed, at least over a length, starting from the cover part (15) of one half up to ⅘ of the overall length (L) of the displacement body (12, 13) directly between the tubular body (20) and the inner surface of the displacement body (12, 13), and extending continuously from the cover part (15) to a securing region of the tubular body (20) in the displacement body shaft (2, 3, and the tubular body (20) passing freely through a first bore (22) in displacement body shaft (2, 3), wherein the first bore (22) in the displacement body shaft (2, 3) then merges into a second bore (24), that has a smaller diameter, in the displacement body shaft (2, 3), in which the tubular body (20) is situated so that it continues to pass through freely, and for forming the securing region, adjoining the second bore (24), a mounting bore (25) having an even smaller diameter is formed in the displacement body shift (2, 3), in which an end (26) of the tubular body (20) is mounted; and wherein the securing region of the tubular body (20) is except for the separate cover part (15) only provided in the motor-gearing chamber (7) of the housing (4, 6).

* * * * *